US005129373A

United States Patent [19]

Cuatt et al.

[11] Patent Number: 5,129,373

[45] Date of Patent: Jul. 14, 1992

[54] SELF-CONTAINED HYDRAULIC LASH ADJUSTER WITH PRESSURIZING DIAPHRAGM

[75] Inventors: Daniel R. Cuatt; Mark A. Shost, both of Henrietta, N.Y.

[73] Assignee: General Motors Corporation, Detroit, Mich.

[21] Appl. No.: 807,918

[22] Filed: Dec. 16, 1991

[51] Int. Cl.[5] ..... F01L 1/24

[52] U.S. Cl. ..... 123/90.55; 123/90.58; 123/90.46

[58] Field of Search ..... 123/90.46, 90.52, 90.53, 123/90.55, 90.58, 90.59; 74/569

[56] References Cited

U.S. PATENT DOCUMENTS

| | | | |
|---|---|---|---|
| 2,109,815 | 3/1938 | Best | 123/90.59 |
| 2,438,631 | 3/1948 | Bergmann | 123/90.59 |
| 2,807,251 | 9/1957 | Peras | 123/90.59 |
| 2,925,074 | 2/1960 | Dadd | 123/90.59 |
| 4,191,142 | 3/1980 | Kodama | 123/90.58 |
| 4,338,894 | 7/1982 | Kodama | 123/90.58 |
| 4,385,599 | 5/1983 | Hori et al. | 123/90.58 |
| 4,402,285 | 9/1983 | Arai et al. | 123/90.58 |
| 4,457,270 | 7/1984 | Kodama et al. | 123/90.58 |
| 4,462,364 | 7/1984 | Kodama | 123/90.55 |

*Primary Examiner*—E. Rollins Cross
*Assistant Examiner*—Weilun Lo
*Attorney, Agent, or Firm*—Robert J. Outland

[57] ABSTRACT

A self-contained lash adjuster includes a closed end cylinder body and a plunger in the cylinder defining a pressure chamber at the closed end of the cylinder and an internal reservoir connected with the chamber by a one-way passage in the plunger. A diaphragm sealing the reservoir is loaded by a spring piston to pressurize the reservoir and apply a differential pressure extending force to the plunger. The plunger is preferably made in two parts with the diaphragm in the lower part defining the chamber and the piston in the upper part distal from the chamber. The two-part construction permits leak-down testing before permanent installation of the diaphragm. A seal in the lower part beyond a return port seals the plunger walls to the cylinder. Installation during assembly of excess fluid for make-up is controlled by positioning of the plunger lower part during filling in a hyper extended position beyond the fully extended position to which the plunger is limited after full assembly of the lash adjuster.

14 Claims, 2 Drawing Sheets

SELF-CONTAINED HYDRAULIC LASH ADJUSTER WITH PRESSURIZING DIAPHRAGM

TECHNICAL FIELD

This invention relates to lash adjusters for use in the valve actuating gear of internal combustion engines and the like. More particularly the invention relates to self-contained hydraulic lash adjusters wherein all of the hydraulic fluid for actuating the valve lash adjusting means is sealed within the lash adjuster. In this connection, the term lash adjuster as used herein is, unless otherwise indicated, intended to include, for example, stationary finger followers (commonly called lash adjusters) which may be used as pivots or reaction members for rocker levers or arms and also other lash adjusting devices such as hydraulic valve lifters or tappets which are usually located in valve trains between the valves and their respective actuating cams.

BACKGROUND

It is known in the art relating to self-contained hydraulic lash adjusters to pressurize the sealed reservoir which supplies hydraulic actuating fluid to the pressure chamber. This can aid the flow of fluid to the pressure chamber upon its expansion for taking up valve lash. Application of the pressure to differential areas of the plunger can also provide additional restoring force for lash take up. Known means for pressurizing the reservoir have included spring loaded pistons and gas filled bellows which define a movable wall of the variable reservoir volume.

Low or ambient pressure reservoir arrangements are also known using various forms of movable wall elements including, for example, collapsible bag diaphragms and rolling diaphragms. The form and mounting of such diaphragms is the subject of a number of patent disclosures in the recent art.

SUMMARY OF THE INVENTION

The present invention provides a self-contained hydraulic lash adjuster featuring a flexible diaphragm defining a movable wall of a reservoir and engaged by a spring loaded piston to pressurize the reservoir fluid.

The plunger is conveniently formed from separate upper and lower members for ease of assembly and manufacture. The lower portion preferably carries a check valve, recirculation port, side seal and a diaphragm defining the reservoir. The upper portion carries a diaphragm loading piston and biasing spring.

Close tolerances are made unnecessary between the piston and upper plunger member by reason of the diaphragm and side seal which control sealing and leakdown functions being mounted in the lower portion. By shaping the reservoir cavity to conform with the shape of the diaphragm, the reservoir volume is minimized so thermal expansion of the contained fluid is limited. Mounting of the diaphragm inward from the outer edge of the plunger provides a differential pressure action on the lower plunger member that urges it against the upper member, supplementing the action of the plunger spring.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
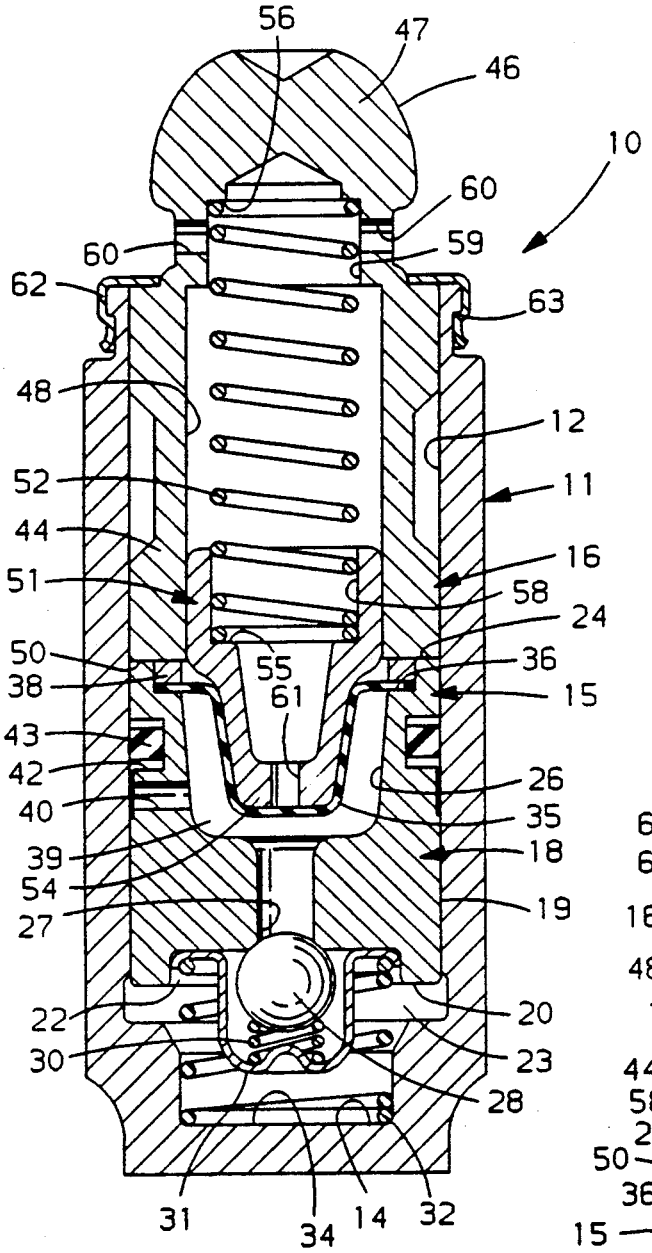
FIG. 1 is an axial cross-sectional view of a finger follower incorporating a self-contained hydraulic lash adjuster with diaphragm means according to the invention, the adjuster and pressurizing piston being shown in their fully extended positions.

Referring now to the drawings in detail, numeral 10 generally indicates a self-contained hydraulic lash adjuster having the form of a finger follower of a type used, for example, for supporting the pivot point of a rocker lever in the valve gear of an overhead cam engine, not shown. The hydraulic lash adjuster 10 has a cylindrical body 11 internally defining a cylinder 12 having a closed end 14. A hollow plunger 15 is reciprocably received in the cylinder 12 and is formed of two separate elements, an upper member 16 and a lower member 18.

The lower member 18 has side walls in the form of a cylindrical outer wall 19 fitted with controlled clearance within the cylinder 12. A lower end wall 20 has a small recess 22 and opposes the closed end 14 of the cylinder to define a pressure chamber 23 therebetween. An upper end 24 of member 18 abuts the upper member and has a deep central recess 26 forming a hollow interior portion of the plunger and connected by an axially extending port 27 with the small recess 22.

A ball check valve 28 in the pressure chamber 23 is biased by a valve spring 30 toward the port 27 to permit flow therethrough only into the chamber 23. A ball retainer or cage 31 containing the ball 28 and spring 30 is seated in the recess 22 and engaged by a plunger spring 32. The spring 32 also engages a spring recess 34 in the cylinder closed end 14 to bias the plunger away from the cylinder end 14.

In accordance with the invention, a rolling flexible diaphragm 35 is held in sealing engagement with an annular seat 36 by a retaining ring 38 near the upper end 24 of the plunger lower member 18. The diaphragm extends across the opening of the central recess 26 to form therewith a closed reservoir 39. A bleed port 40 connects the reservoir with the close clearance between the cylinder 12 and the outer wall 19. An annular groove 42 around the lower member 18 between the port 40 and the upper end 24 contains a seal ring 43 to prevent the escape of fluid from the sealed hydraulic system including the reservoir 39 and pressure chamber 23.

The shape of the lower plunger recess 26 is preferably contoured to surround closely the shape of the diaphragm in its fully extended position as shown in FIG. 1. This minimizes the non-functional volume of fluid in the reservoir 39 and the total volume of trapped fluid in the sealed hydraulic system. The change of volume and resulting diaphragm displacement caused by thermal expansion of the fluid is thus limited.

The plunger upper member 16 comprises a hollow body 44 reciprocably movable in the cylinder 12 and having a rocker pivot 46 at the upper or outer end 47. The hollow interior forms an inner cylinder 48 open through the lower end 50 of member 16 which abuts the upper end 24 of the lower member 18. A piston 51 slidable in the inner cylinder 48 is biased by a pressure spring 52 into engagement with the diaphragm 35. The diaphragm is contacted by a protruding portion 54 of the piston 51 which is shaped in tapered fashion to guide the rolling motion of the diaphragm and support it against fluid pressure in the reservoir 39.

The spring 52 seats against shoulders 55, 56 of recesses 58, 59 in the piston 51 and upper member 16, respectively. The inner cylinder 48 is vented through openings 60 in the upper member and the piston 51 also has a vent 61 in its nose, which is hollow to minimize weight. The plunger 15 is retained in the cylinder 12 by a retainer 62 which snaps on the open end of the body 11 and engages a shoulder 63 of the upper member 16. Since all of the sealing components and leakdown control tolerances are connected with the plunger lower member 18, the dimensional tolerances of the upper member are not as critical and its manufacturing and assembly costs are thus minimized.

During assembly, prior to seating of the diaphragm 35 and installation of the upper member 16, the volume in and surrounding the plunger lower member 18, including the pressure chamber 23 and the reservoir 39, is filled with hydraulic oil or fluid suitable for use in a self contained, sealed lash adjuster. The partially assembled unit can at that time be checked for leakdown of fluid past the plunger under load before final assembly. In this way, unsatisfactory components can be detected and replaced or reworked without destruction of any of the assembled components, such as the diaphragm 35 and its retaining ring 38, which are not yet installed.

Figure 2:
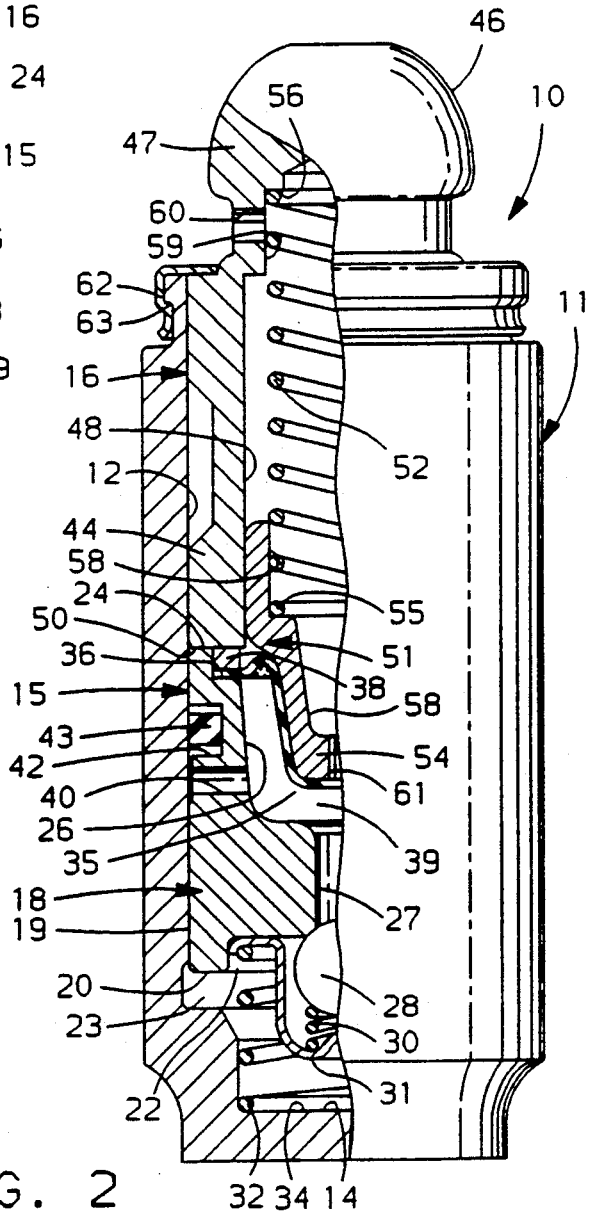
FIG. 2 is a view of a fragmentary portion of the adjuster of FIG. 1 shown fully extended but with excess fluid fill for loss compensation maintaining the piston at less than full extension.
Figure 3:
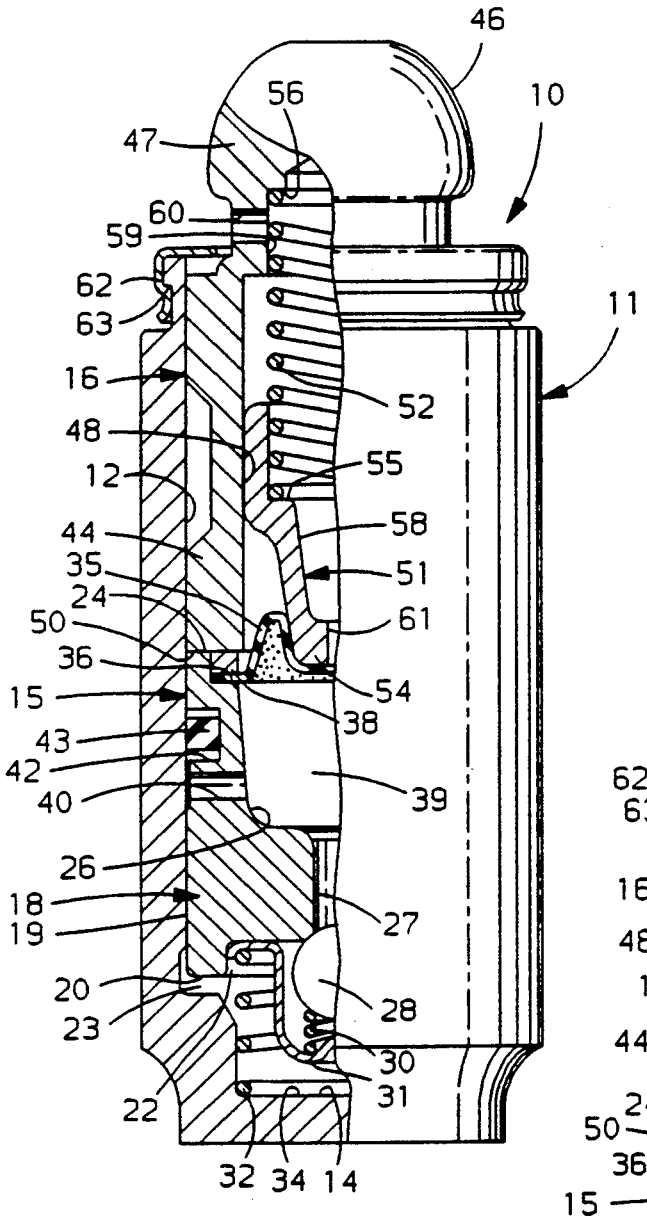
FIG. 3 is a view of a fragmentary portion of the adjuster of FIG. 1 shown in a partially extended position.
Figure 4:
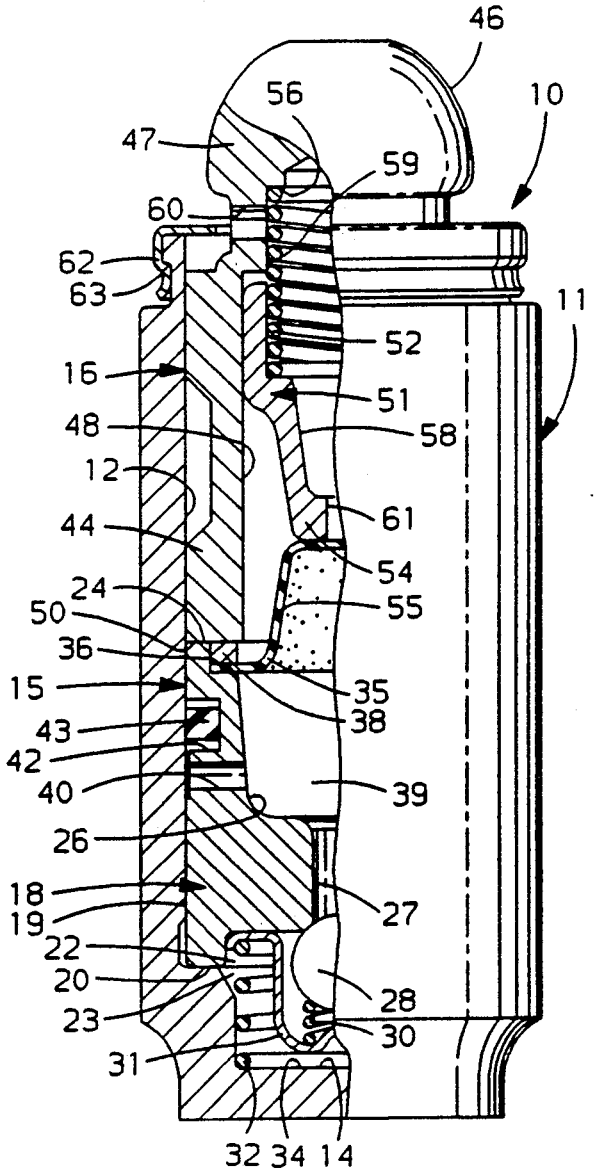
FIG. 4 is a view similar to FIG. 2 showing the adjuster in a fully collapsed position.

The amount of fluid supplied is preferably slightly more (for example ten percent greater) than needed to fill the volume below the diaphragm when it is fully extended as shown in FIG. 1. Thus, after assembly, when the lash adjuster 10 is fully extended, the excess fluid will maintain a slight upward positioning of the diaphragm 35 with an equivalent slightly retracted position of the piston 51 as shown in FIG. 2. This allows for some small loss of fluid from the sealed unit without any loss of reservoir pressure over the complete range of travel of the lash adjuster plunger 15. FIG. 3 shows the assembled lash adjuster and its piston 51 and diaphragm 35 in intermediate, partially extended positions and FIG. 4 shows the lash adjuster 10 in the fully collapsed position with the diaphragm 35 and piston 51 retracted to their upper positions as might occur at elevated operating temperatures. At lower temperatures, the contraction in volume of the hydraulic fluid in the lash adjuster will be accommodated by a corresponding extension downward of the piston and diaphragm positions.

Providing the desired excess of hydraulic fluid in the lash adjuster is preferably performed while the plunger lower member 18 is in a hyper extended position sufficiently above the fully extended position to allow the desired volume of excess fluid to enter the pressure chamber 23. The diaphragm 35 and sealing ring 38 are then installed and seated, sealing the charge of fluid in the system with the diaphragm in its fully extended position as in FIG. 1 but with the lower member 18 hyper extended. Subsequent assembly of the upper member 16 forces the lower member 18 to its normal extended position as in FIGS. 1 and 2, displacing the excess fluid from the pressure chamber 23 into the reservoir 39 and raising the diaphragm and piston slightly to their FIG. 2 positions.

In use, the lash adjuster body 11 is fixedly received in an engine component, such as a cylinder head. The plunger upper member extends from the body 11 with the pivot 46 in engagement with a seat in a lever or rocker arm of an engine valve train. The lever may, for example, also be engaged by a cam and contact a valve for actuation of the valve by the cam with the lever reacting against the pivot 46.

When the valve is closed and the lever rides on the cam base circle, the lash adjuster is unloaded and acts to take up lash in the valve train. This is accomplished in part because the spring 32 urges the plunger 15 upward in the body 11 until the lash is taken up. This normally occurs before the plunger reaches the end of its travel and contacts the retainer 62 as shown in FIG. 1, otherwise the lash may not be fully taken up.

In addition, the force of the pressure spring 52 against the piston 51 forces the diaphragm 35 against the sealed charge of fluid partially contained in the reservoir 39. This raises the reservoir pressure above ambient and assists in unseating the ball valve 28 from its seat and forcing fluid through the port 27 into the pressure chamber 23. Since the transverse projected area of the plunger lower end wall 20 and the attached valve assembly exposed to the pressure chamber is greater than the transverse projected area of the plunger exposed to the reservoir 39, a differential pressure force is developed as the pressure in the pressure chamber 23 approaches that in the reservoir 39. This force adds to that of the spring 32 in urging the plunger upward to take up the valve train lash.

When the cam rotates to force the lever to move in a valve opening direction, the reaction force against the pivot 46 is carried through the upper and lower members 16, 18 of the plunger 15 to the fluid in the pressure chamber 23, raising its pressure above that in the reservoir 39. This forces the ball valve 28 to seat firmly and trap the fluid in the pressure chamber, allowing the lash adjuster to act as a nearly solid member in the valve train during the valve opening event.

However, during each valve lift event, a small amount of fluid passes from the pressure chamber 23 through a controlled close clearance between the cylinder 12 and the plunger lower member 18. This leakdown fluid is returned to the reservoir 39 through the bleed port 40. Thus a controlled leakdown occurs which introduces a small amount of lash in the valve train when the valve is again closed. This lash is then taken up in the manner previously described.

The hydraulic system including the reservoir 39 and pressure chamber 23 is sealed by the seal ring 43 against significant loss of the hydraulic fluid provided during assembly of the lash adjuster. However, the provision of excess fluid during assembly permits a loss of the excess fluid to occur without limiting the full lash adjustment travel of the plunger 15.

While the invention has been described by reference to preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A hydraulic lash adjuster of the self-contained type including a body defining a cylinder with a closed end, a hollow plunger internally defining a fluid reservoir, the plunger having side walls slidably fitted in the cylinder and an end wall cooperating with the cylinder closed end to define a chamber for fluid in thrust transmitting relation between the cylinder and plunger, said plunger end wall having a one-way passage therethrough for fluid flow from the reservoir to the camber, said plunger side walls having a port extending therethrough intermediate their ends for returning fluid to the reservoir, said fluid having escaped externally of the plunger from the chamber, the plunger side walls being sealed to the cylinder beyond the port relative to the body closed end, said plunger further defining an inner cylinder open toward the reservoir, a piston slidable in the inner cylinder and a spring urging the piston toward the reservoir with a force effective to raise the reservoir pressure substantially above ambient pressure, and the improvement comprising a flexible diaphragm extending across the hollow plunger between the piston and the reservoir and sealingly mounted in the side walls to define a sealing wall with a central portion movable to vary the volume of the reservoir, the piston engaging said central portion of the diaphragm and being shaped to partially support the diaphragm against the force of pressure in the reservoir.

2. A hydraulic lash adjuster as in claim 1 wherein said plunger is formed with separate upper and lower members, said upper member defining the inner cylinder and supporting the piston and spring.

3. A hydraulic lash adjuster as in claim 2 wherein said upper and lower members further include open ends engagable with one another, an annular recess in one of said open ends and receiving an edge portion of the diaphragm and retaining means received in the annular recess for sealingly retaining the diaphragm.

4. A hydraulic lash adjuster as in claim 3 wherein said diaphragm is retained in said lower member.

5. A hydraulic lash adjuster as in claim 4 wherein said diaphragm is a form of rolling diaphragm such that its contact with said piston is such as to avoid any substantial relative sliding motion.

6. A hydraulic lash adjuster as in claim 5 wherein said upper member includes a seat for engaging a movable component of an engine valve train.

7. A hydraulic lash adjuster as in claim 6 wherein said seat is a rocker pivot.

8. A hydraulic lash adjuster as in claim 2 wherein said diaphragm is retained in said lower member.

9. A hydraulic lash adjuster as in claim 8 wherein said piston is carried by said upper member.

10. A hydraulic lash adjuster as in claim 9 and further comprising seal means between the cylinder and said lower member and between said port and and outer end of said lower member distal from said pressure chamber to seal the plunger side walls to the cylinder.

11. A hydraulic lash adjuster as in claim 9 wherein said lower member contains a recess into which said diaphragm extends, the recess conforming closely with the shape of the diaphragm when fully extended and having minimal clearance to limit the volume of non-working fluid in the lash adjuster.

12. A hydraulic lash adjuster as in claim 9 wherein the reservoir contains a predetermined excess of fluid such that the piston and diaphragm are partially retracted when the lash adjuster is fully extended.

13. A method of making a lash adjuster of the self-contained type including the steps of:

providing a body defining a cylinder with a closed end, installing in the body a hollow lower plunger member internally defining a fluid reservoir having an open end adapted to receive a flexible sealing diaphragm, the plunger member having side walls slidably fitted in the cylinder and an end wall cooperating with the cylinder closed end to define a chamber for fluid in thrust transmitting relation between the cylinder and plunger, said plunger member end wall having a one-way passage therethrough for fluid flow from the reservoir to the chamber, said plunger member side walls having a port extending therethrough intermediate their ends for returning fluid to the reservoir, said fluid having escaped externally of the plunger member from the chamber, providing seal means between the plunger member side walls and the cylinder beyond the port relative to the body closed end, filling the chamber and reservoir with a charge of hydraulic fluid, testing the leakdown characteristics of the partial assembly, thereafter installing the sealing diaphragm to close the open end of the reservoir, and providing a biased piston engaging the sealing diaphragm to raise the reservoir pressure.

14. A method as in claim 13 wherein the plunger member has a fully extended position in which it is spaced as far from the closed end of the body as is possible when the lash adjuster is fully assembled, and said step of filling is performed with said plunger member hyper extended beyond its fully extended position such that an excess volume of fluid is installed in the chamber to provide an excess in the reservoir after assembly in the fully extended position of the plunger member.

* * * * *